US006371337B2

(12) United States Patent
Garcia et al.

(10) Patent No.: US 6,371,337 B2
(45) Date of Patent: Apr. 16, 2002

(54) DISPENSING MEMBER HAVING AN OUTLET VALVE FORMED BY A DIFFERENTIAL PISTON

(75) Inventors: Firmin Garcia, Evreux; Stéphane Beranger, Le Neubourg, both of (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/809,877

(22) Filed: Mar. 16, 2001

(30) Foreign Application Priority Data

Mar. 20, 2000 (FR) ..... 00 03533

(51) Int. Cl.[7] ..... B67D 5/40

(52) U.S. Cl. ..... 222/385; 222/380; 222/321.2; 222/321.7; 222/321.8; 222/321.9

(58) Field of Search ..... 222/321.2, 321.1, 222/321.6, 321.7, 321.9, 321.8, 380, 385

(56) References Cited

U.S. PATENT DOCUMENTS 4,227,628 A * 10/1980 Parsons ..... 222/380
4,317,531 A * 3/1982 Saito et al. ..... 222/321
5,217,148 A * 6/1993 Cater ..... 222/321
5,482,188 A * 1/1996 Lina ..... 222/321.2
5,671,874 A * 9/1997 Behar et al. ..... 222/341
6,012,615 A 1/2000 Brunet et al.
6,161,732 A * 12/2000 Albini ..... 222/321.3
6,170,713 B1 * 1/2001 Schultz ..... 222/321.2
6,186,371 B1 * 2/2001 de Pous et al. ..... 222/380
6,196,424 B1 * 3/2001 Bougamont et al. ..... 222/321.9
6,206,246 B1 * 3/2001 Bougamont et al. ..... 222/321.9
6,209,759 B1 * 4/2001 Hermouet et al. ..... 222/321.2
6,237,814 B1 * 5/2001 Blyler et al. ..... 222/189.09

OTHER PUBLICATIONS

Rapport De Recherche Préliminaire for FR 00.03533.

* cited by examiner

*Primary Examiner*—John Kwon
*Assistant Examiner*—Frederick C Nicolas
(74) *Attorney, Agent, or Firm*—Rockey, Milnamow & Katz, Ltd.

(57) ABSTRACT

A fluid-dispensing member comprising:

a body defining a chamber;

an actuating rod provided with a pusher;

a piston mounted on the actuating rod to slide in leaktight manner in the chamber;

an inlet valve; and an outlet valve;

wherein the outlet valve comprises a differential piston that can be moved under the action of the pressure exerted on the fluid by the piston against the action of a spring which abuts at one end against the differential piston, and at its other end against the pusher.

10 Claims, 2 Drawing Sheets

DISPENSING MEMBER HAVING AN OUTLET VALVE FORMED BY A DIFFERENTIAL PISTON

TECHNICAL FIELD

The present invention relates to a dispensing member for dispensing a fluid, which dispensing member is designed to be mounted on the neck of a container. Conventionally, such a dispensing member comprises a body defining a chamber, an actuating rod provided with a pusher, a piston mounted on the actuating rod to slide in leaktight manner in the chamber, an inlet valve, and an outlet valve. By depressing the pusher, the piston is moved, thereby reducing the volume of the pump chamber, and thereby putting the fluid contained therein under pressure. The inlet valve closes and the outlet valve opens so as to deliver the fluid from the chamber to the outside.

BACKGROUND OF THE INVENTION

In the prior art, numerous dispensing members already exist such as pumps, in which the outlet valve is situated inside the pump chamber and is mounted to slide on the actuating rod. In which case, the piston is formed by sleeving whose outside periphery defines a sealing lip serving to slide in leaktight manner against the inside wall of the body. In addition, the sleeving slides on the actuating rod so as to cover and uncover selectively one or more outlet orifices communicating with an internal duct formed inside the actuating rod. Naturally, in that type of dispensing member, the outlet orifice is situated on the pusher so that it moves therewith. That type of dispensing member is described, in particular, in Document WO 95/29016. The piston is urged by a spring that abuts at one end against the piston sleeving, and at the other end against an abutment collar formed by an actuating rod.

Unfortunately, that type of pump suffers from the disadvantage that the outlet valve member is coupled directly to the piston. It is therefore not possible to create or to take advantage of a ratio effect which would make it possible either to stiffen or to slacken operation of the pump, and in particular opening the pump outlet valve.

OBJECTS AND SUMMARY OF THE INVENTION

To make this possible, the present invention provides a fluid-dispensing member comprising:

a body defining a chamber;

an actuating rod provided with a pusher;

a piston mounted on the actuating rod to slide in leaktight manner in the chamber;

an inlet valve; and an outlet valve;

the outlet valve comprising a differential piston that can be moved under the action of the pressure exerted on the fluid by the piston against the action of a spring which abuts at one end against the differential piston, and at its other end against the pusher. The piston and the differential piston are thus totally dissociated from each other, so that each of them moves separately. In other words, they may have strokes and diameters that are different. For example, the differential piston may have a diameter that is larger than the diameter of the piston that is mounted to slide in the chamber.

According to a characteristic of the invention, said differential piston is mounted to slide in the body.

Advantageously, the body defines a cylindrical section in which the differential piston is slidably received, said cylindrical section being provided with a through hole that can be closed off selectively by said differential piston. In which case, the dispensing member has a stationary spray, i.e. it is provided with a dispensing orifice which does not move with the rod and with the pusher.

In a practical embodiment, a ferrule is engaged in the body to define the rest position of the piston, said differential piston being urged against said ferrule by the spring. Advantageously, the differential piston is mounted to slide in leaktight manner on cylindrical sleeving formed by the ferrule. The ferrule performs two functions, namely it acts as an abutment for the piston in the rest position, and as an abutment for the differential piston, also in the rest position. In addition, the cylindrical sleeving of the ferrule also serves as guide means for guiding the actuating rod in order to keep it in alignment.

In an embodiment, the differential piston is disposed between the pusher and the ferrule. In addition, the spring is situated outside the chamber. Furthermore, the differential piston is situated outside the chamber.

BRIEF DESCRIPTION OF THE DRAWINGS

The invention is described more fully below with reference to the accompanying drawings which show an embodiment of the present invention by way of non-limiting example.

In the drawings.

MORE DETAILED DESCRIPTION

Figure 1:
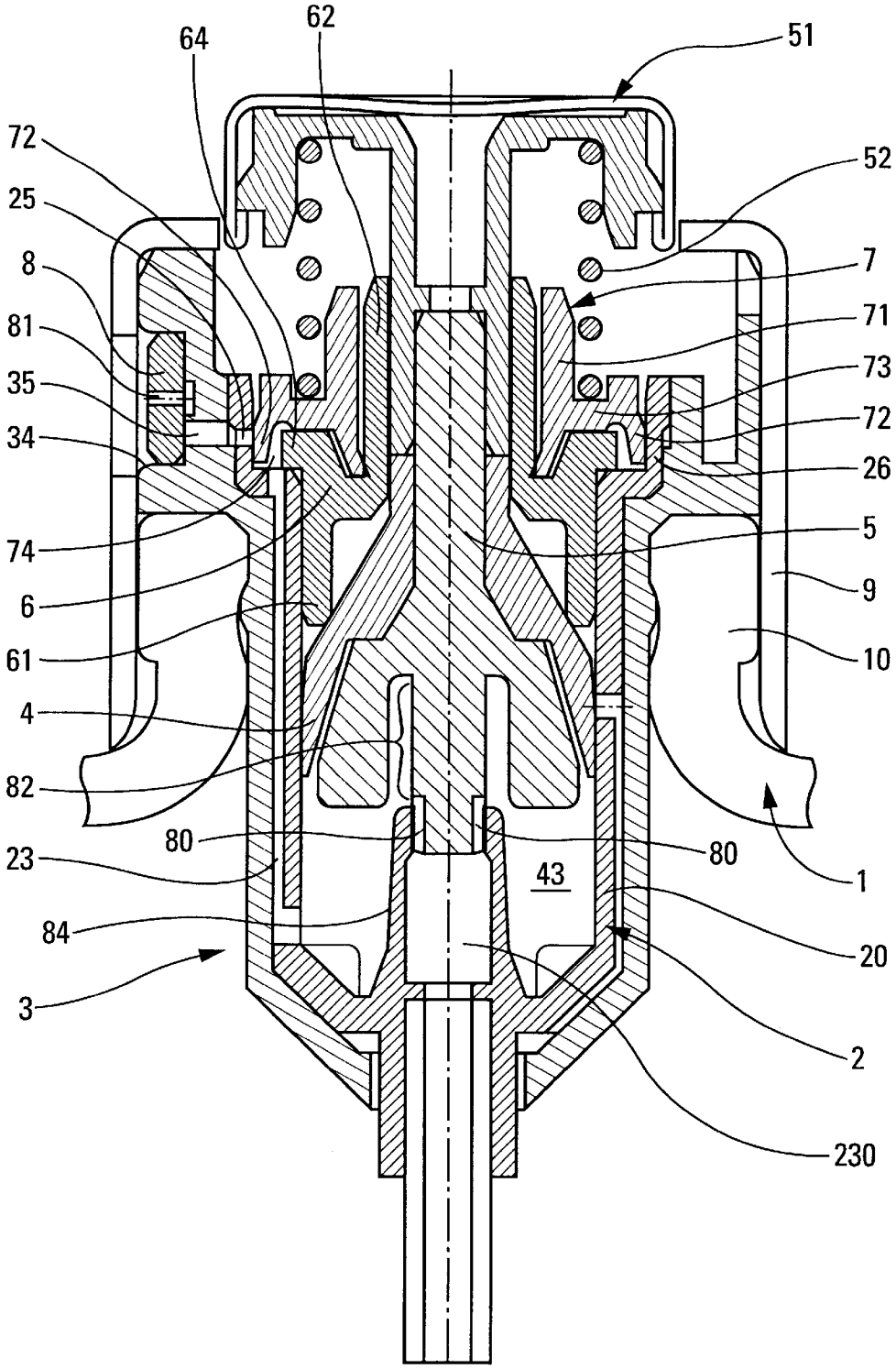
FIG. 1 is a vertical cross-section view through a dispensing member mounted on the neck of a container, said member being in the rest position.

Reference is made firstly to FIG. 1 to describe the structure of a preferred embodiment of a dispensing member of the invention. In this example, the fluid-dispensing member is a pre-compression pump and it is shown as mounted on the neck 10 of a container. To fix it, a fixing ring 3 is used that co-operates with the inside wall of the neck 10, e.g. by snap-fastening. The fixing ring 3 may also form a recess 34 in which a nozzle 8 is engaged. The pump is then of the stationary spray type.

To mask the fixing ring 3 and the neck 10, a trim band 9 is provided, e.g. made of metal.

The pump also includes a body 2 engaged inside the fixing ring 3.

Figures 2A, 2B, 2C:
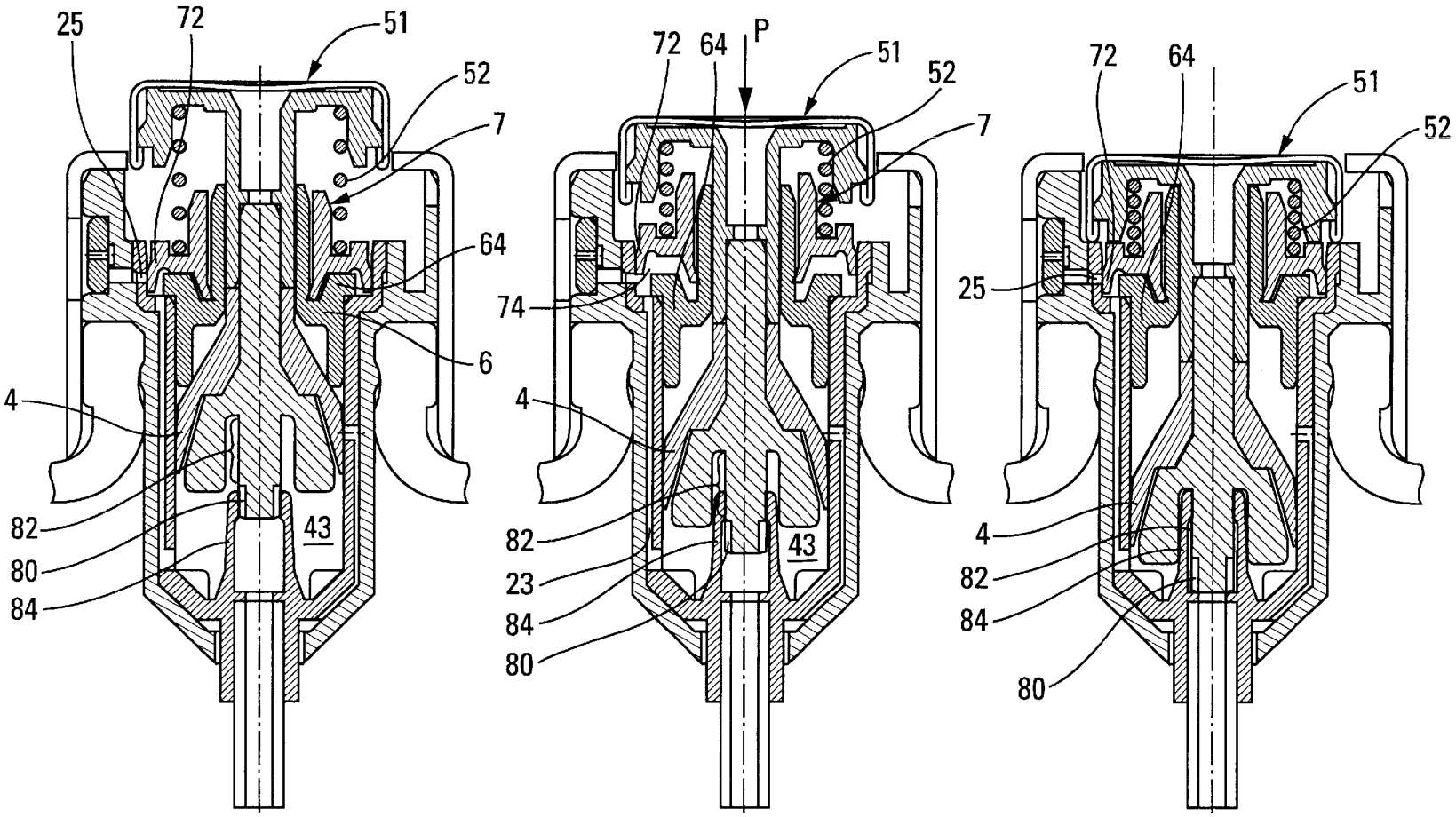
FIGS. 2*a*, 2*b*, and 2*c* are views in cross-section serving to show how the dispensing member of FIG. 1 operates.

A piston 4 is mounted to slide inside a barrel 20 defined by the body 2. The piston 4 is mounted on the end of an actuating rod 5 which is terminated at its top end by a pusher 51 which is depressed to actuate the pump. The piston 4 and the body 2 co-operate to define a pump chamber 43 which communicates with the container via an inlet 230. The inlet 230 is defined by a tube 84 which projects upwardly into the pump chamber 43. The actuating rod 5 extends downwardly below the piston 4 and into the upper end of the inlet tube 84. The bottom end of the actuating rod 5 defines a plurality of grooves or channels 80. In the unactuated, rest position of the pump as illustrated in FIG. 1 and in FIG. 2*a,* the grooves or channels 80 extend upwardly somewhat beyond the upper end of the inlet tube 84 so as to provide a fluid flow path or communication between the pump inlet 230 and the pump chamber 43. Above the upper end of the channels 80 the actuating rod 5 has a generally smooth, cylindrical surface seal portion 82. When the piston 4 and actuating rod 5 are moved downwardly to a partially actuated position as shown in FIG. 2*b* or to a fully actuated position as shown in FIG. 2*c*, the actuating rod seal portion 82 is sealingly engaged with the upper end of the surrounding inlet tube 84 to prevent flow into the pump chamber 43 from the inlet 230. These three elements—the inlet tube 84, the channels 80 at the bottom end of the actuating rod 5, and the seal portion 82 on the actuating rod above the channels 80—together function as an "inlet valve" to operate between an open position as illustrated in FIGS. 1 and 2*a* and closed positions as illustrated in FIGS. 2*b* and 2*c*. In addition, the pump chamber is connected to the nozzle 8 via a delivery channel 23 which is formed between the body 2 and the fixing ring 3.

A ferrule 6 is further engaged in the pump body 2. The ferrule 6 includes a bushing 61 that forms an abutment surface at its bottom end for the piston 4 in the rest position. In addition, the ferrule 6 forms sleeving 62 through which the actuating rod 5 extends. The sleeving 62 therefore constitutes guide means for maintaining the actuating rod 5 in alignment. The ferrule also defines an abutment surface 64.

In the invention, a differential piston 7 is provided to serve as a moving outlet valve member. The differential piston 7 is urged by a spring 52 against the abutment surface 64 of the ferrule 6. The spring 52 abuts at one end against the differential piston 7 and at its other end against the bottom face of the pusher 51. The differential piston 7 is provided with a central sleeve 71 serving to slide in leaktight manner on the sleeving 62 formed by the ferrule 6. In addition, the differential piston is provided with an external sealing lip 72 in leaktight sliding contact with the body 2. More precisely, the body 2 forms at its top end a cylindrical section 26 slidably receiving the differential piston 7. The cylindrical section 26 is provided with a through a hole 25 that communicates with an outlet duct 35 formed by the fixing ring 3. From there, the fluid can flow through the nozzle 8, advantageously via a swirl chamber and channels 81. Since the sealing lip 72 of the differential piston 7 is mounted to slide against the inside wall of the cylindrical section 26, it selectively covers and uncovers the through hole 25. Therefore, the fluid coming from the pump chamber 43 via the delivery channel 23 can flow out through the through hole 25 when the differential piston 7 uncovers the hole 25. In other words, the fluid at the outlet of the delivery channel 23 penetrates into an outlet valve chamber 74 whose volume increases when the pressure inside the pump chamber 43 is high enough to cause the differential piston 7 to rise on the sleeving 62 of the ferrule 6 against the spring 52. Therefore, it should also be noted that the spring 52 serves both as a return piston and as a pre-compression piston.

In the invention, the inside diameter of the cylindrical section 26 is different from the inside diameter of the barrel 20 of the body 2 in which the piston 4 is slidably-mounted. In the embodiment shown, the diameter of the cylindrical section 26 is larger than the diameter of the barrel so that a ratio effect is created, since the differential piston 7 slides over a stroke that is shorter than the stroke of the piston 4. The differential piston 7 needs merely to move over less than one millimeter in order to uncover the through hole 25, whereas the piston 4 moves over nearly one centimeter.

It should also be noted that the single return and pre-compression spring 52 is situated outside the chamber 43, i.e. out of contact with the fluid to be dispensed.

It should also be noted that the ferrule 6 performs several functions at the same time in this pump, namely it acts as top dead center for the piston 4, as abutment for the differential piston 7, and as guide means with its sleeving 62 for the actuating rod 5. In addition, the ferrule 6 performs an additional function of locking, with its bushing 61, by locking the snap-fastening of the fixing ring 3 inside the neck 10 of the container 1. Such a ferrule 6 may, for example, be implemented with a differential piston having other characteristics.

Reference is made below to FIGS. 2*a*, 2*b*, and 2*c* to explain a full actuating cycle of such a pump. In the position shown in FIG. 2*a*, the piston 4 is in its top position in abutment against the ferrule 6. No pressure is exerted on the pusher 51, and the spring 52 is in its most relaxed state, with the differential piston 7 urged against the ferrule 6. The through hole 25 is then closed off by the external peripheral lip 72 on the differential piston 7. By exerting pressure on the pusher 51, the piston 4 descends inside the pump chamber 43 and the fluid stored therein is delivered via the delivery channel 23 to the outlet valve chamber 74. The fluid under pressure causes the differential piston to move against the spring 52 until the external peripheral lip 72 uncovers the through hole 25, as shown in FIG. 2*b*. The fluid can then be discharged via the through hole 25 and via the nozzle. The outlet valve remains open so long as the pressure is high enough to maintain the lip 72 above the through hole 25. When the pusher 51 is fully pushed in, as shown in FIG. 3, there is almost no fluid left inside the chamber 43, and the pressure has fallen completely so that the spring 52 can return the differential piston 7 to its rest position in abutment against the ferrule 6. The through hole 25 is then covered over once again by the lip 72. By releasing the pressure on the pusher 51, the piston is caused to rise again under the return action of the spring 52, while the differential piston remains completely stationary, pressed against the ferrule 6. The piston 4 rising again causes fluid to be sucked up into the chamber from the container. The operating cycle is then complete.

What is claimed is:

1. A fluid-dispensing member comprising:

a body having an outlet and defining a chamber having an inlet;

a piston that is slidably disposed in a leaktight manner in the chamber for movement in said chamber between an inwardly moved position for pressurizing said chamber and an outwardly moved position for depressurizing said chamber;

a pusher connected to said piston;

an inlet valve member associated with said inlet to close and open said inlet in response to chamber pressurization and depressurization, respectively;

a differential piston slidably and sealingly disposed in said body outwardly of said piston for movement between an inwardly moved position closing said outlet and an outwardly moved position opening said outlet; and a compression spring acting between said pusher and said differential piston to bias said differential piston toward said inwardly moved position whereby said differential piston can be moved against the force of the spring under the action of the pressure exerted on the fluid by the piston to open said outlet.

2. A dispensing member according to claim 1, in which said differential piston has a lip that is mounted to slide in the body.

3. A dispensing member according to claim 1, in which a ferrule is engaged in the body to define the rest position of the piston, said differential piston being urged against said ferrule by the spring.

4. A dispensing member according to claim 1, in which the spring is situated outside the chamber.

5. A dispensing member according to claim 1, in which the differential piston is situated outside the chamber.

6. A dispensing member according to claim 2, in which the body defines a cylindrical section in which the differential piston is slidably received, said cylindrical section being provided with a through hole that can be closed off selectively by said differential piston.

7. A dispensing member according to claim 3, in which the differential piston is disposed between the pusher and the ferrule.

8. A dispensing member according to claim 6, in which the differential piston is mounted to slide in leaktight manner on a cylindrical sleeve formed by a ferrule.

9. A dispensing member according to claim 6, in which the cylindrical section has an inside diameter different from the inside diameter of the chamber in which the piston is mounted to slide.

10. A dispensing member according to claim 9, in which the inside diameter of the cylindrical section is greater than the inside diameter of the chamber.

* * * * *